US005816428A

United States Patent [19]

Plester

[11] Patent Number: 5,816,428

[45] **Date of Patent: *Oct. 6, 1998**

[54] EASY-OPEN CAN END AND SPOUT

[75] Inventor: George Plester, Belgique, Belgium

[73] Assignee: The Coca-Cola Company, Atlanta, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 661,155

[22] Filed: Jun. 10, 1996

Related U.S. Application Data

[63] Continuation of Ser. No. 313,872, Sep. 28, 1994, abandoned.

[51] Int. Cl.[6] ..... B65D 77/28; B65D 17/00; B65D 25/44

[52] U.S. Cl. ..... 220/257; 220/270; 220/281; 220/717; 222/527

[58] Field of Search ..... 220/254, 256, 220/257, 259, 266, 270, 276, 281, 283, 291, 292, 375, 707, 711–713, 716–718, 721, 272.5; 222/566–569, 527–528, 541.9, 491, 494; 215/306, 386–389

[56] References Cited

U.S. PATENT DOCUMENTS

| | | | |
|---|---|---|---|
| 2,258,145 | 10/1941 | Woodman | 220/212.5 |
| 2,594,467 | 4/1952 | Lynch, Jr. et al. | 220/259 X |
| 2,804,242 | 8/1957 | Borah | 222/527 |
| 2,895,654 | 7/1959 | Rieke | 220/212.5 |
| 3,075,676 | 1/1963 | Borah | 222/527 |
| 3,093,273 | 6/1963 | Borah | 222/527 |
| 3,135,441 | 6/1964 | Wise et al. | 220/257 X |
| 4,403,709 | 9/1983 | Meins et al. | 220/257 X |
| 4,442,949 | 4/1984 | Dwinell et al. | 220/257 |
| 4,513,870 | 4/1985 | Zaltsman | 215/306 |
| 4,548,332 | 10/1985 | Neat | 220/375 X |
| 4,632,288 | 12/1986 | Nagashima . | |

FOREIGN PATENT DOCUMENTS

| | | |
|---|---|---|
| 0409759A1 | 1/1991 | European Pat. Off. . |
| 0744355A1 | 11/1996 | European Pat. Off. . |
| 1228265 | 8/1960 | France . |
| 1202922 | 8/1970 | United Kingdom . |
| 86/01488 | 3/1986 | WIPO . |
| 96/03331 | 2/1996 | WIPO . |

*Primary Examiner*—Allan N. Shoap
*Assistant Examiner*—Nathan Newhouse
*Attorney, Agent, or Firm*—Birch, Stewart, Kolasch & Birch, LLP

[57] ABSTRACT

To provide a can-lid with pop-out-spout, a folded, plastic spout is secured on the underside of a metal can-lid, which is conventionally roll-seamed onto the can-body. This is achieved either by gluing, or by plastic-coating the underside of the lid and heat-sealing the spout to the lid, or by incorporating the tips of the spout's flange in the roll-seamed joint of the can-lid, or other appropriate means. When the can is opened, the spout is released and either unfolds automatically due to the beverage's pressure (in case of carbonated beverages), or can be pulled out by the user. The spout is provided wither with a screw-closure, or with a twist-off, flick-open closure. In one version, the spout is completely covered by the can-lid, which is provided by an opening feature which enables an opening large enough for the spout to pass out. In a further version, the can-lid has a pre-cut aperture, behind which the closure on the spout is locked until the user opens by twisting the closure to free it from aperture. Pilfer-evidence is provided by the can-lid itself, where this has no pre-cut aperture, or by making the handles of the closure pilfer-evident when bent out, or by applying a label across the pre-cut aperture.

15 Claims, 5 Drawing Sheets

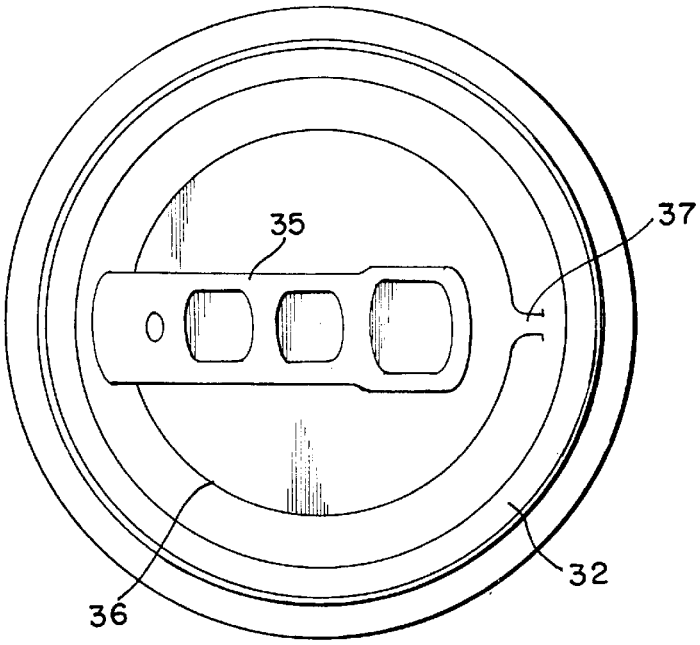
FIG. IC
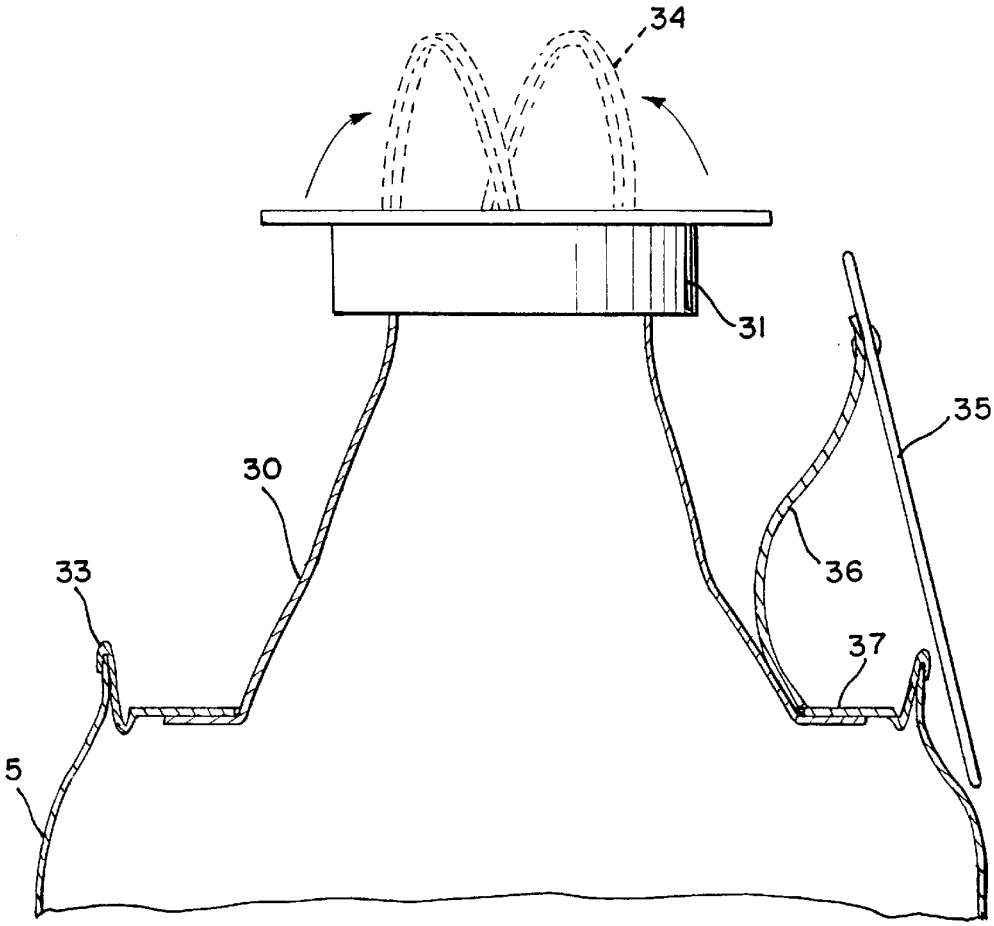
FIG. IB

EASY-OPEN CAN END AND SPOUT

This application is a continuation of application Ser. No. 08/313,872 filed on Sep. 28, 1994, now abandoned.

BACKGROUND OF THE INVENTION

The present invention relates to a can end assembly for a metal beverage can. More specifically, the present invention relates to a can-lid for a metal beverage can having a foldable, pop-out spout.

Current can-ends for beverage cans are generally of the "ring-pull" or "press-down-stay-on-tab" type and have some disadvantages.

Generally, they are not resealable. The tabs are difficult to open. The opening size/shape is not ideal for drinking.

Most current can-ends for beverages are aluminum, and since these are joined to the can-body by roll-seaming, recycling is more difficult when using steel-body cans. A design of can-end which is either less firmly attached to the body, or easily produced from either steel or aluminum, would be environmentally friendlier by enabling single material packages.

Finally, designs of can-ends which enable easy inclusion of a hidden-gift, or other promotional material, which is only accessible when the can is opened, would give significant promotional advantages in the market-place, compared with current can-ends.

SUMMARY OF THE INVENTION

Accordingly, it is the object of this invention to provide can-end systems, which are recloseable, easy-open, easy-drink; and which enable single-metal can systems and hidden-gift promotional possibilities.

The foregoing and other objects of this invention are fulfilled by providing a can end assembly comprising:

a can body having an open end and a closed end;

a can-lid secured to the can body over the open end, said can-lid having a central severable portion and a peripheral portion secured to the can body;

a foldable spout secured to the underside of the peripheral portion of the can lid, and movable between a first position recessed within said can body and a second position extending from said can body when the central severable portion is severed from the can-lid; and a pull tab connected to the central portion of the can-lid.

To provide a can-lid with pop-out-spout, a folded, plastic spout is secured on the underside of a metal can-lid, which is conventionally roll-seamed onto the can-body. This is achieved either by gluing, or by plastic-coating the underside of the lid and heat-sealing the spout to the lid, or by incorporating the tips of the spout's flange in the roll-seamed joint of the can-lid, or other appropriate means. When the can is opened, the spout is released and either unfolds automatically due to the beverage's pressure (in case of carbonated beverages), or can be pulled out by the user. The spout is provided with a screw-closure, or with a twist-off, flick-open closure. In one version, the spout is completely covered by the can-lid, which is provided by an opening feature which enables an opening large enough for the spout to pass out. In a further version, the can-lid has a pre-cut aperture, behind which the closure on the spout is locked until the user opens by twisting the closure to free it from the aperture. Pilfer-evidence is provided by the can-lid itself, where this has no pre-cut aperture, or by making the handles of the closure pilfer-evident when bent out, or by applying a label across the pre-cut aperture.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein:

FIGS. 1A to 1C show the embodiment of a metal-lid, with easy-opening feature and large, fold-back opening panel which permits a folded-up spout mounted under the metal-lid to pass through the aperture created by the opening of the metal-lid;

DETAILED DESCRIPTION OF PREFERRED EMBODIMENTS

Figure 1A:
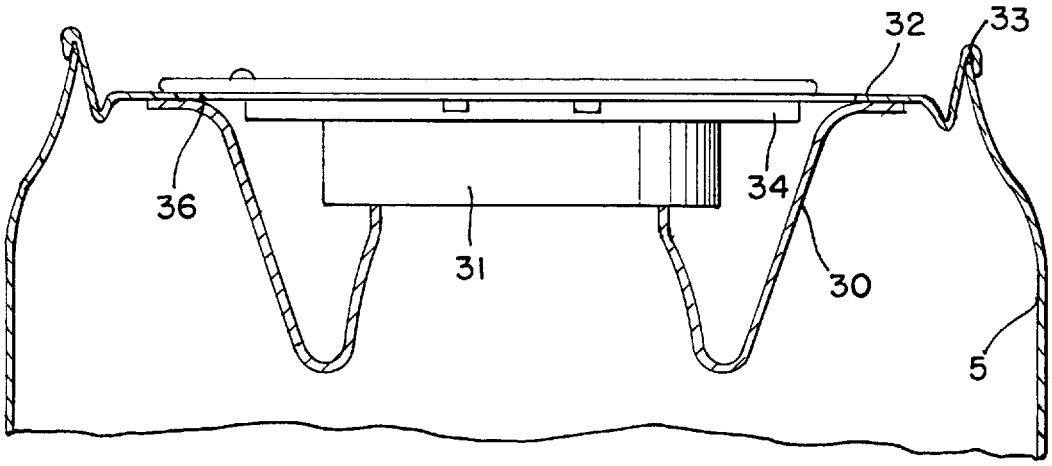
Figure 2A:
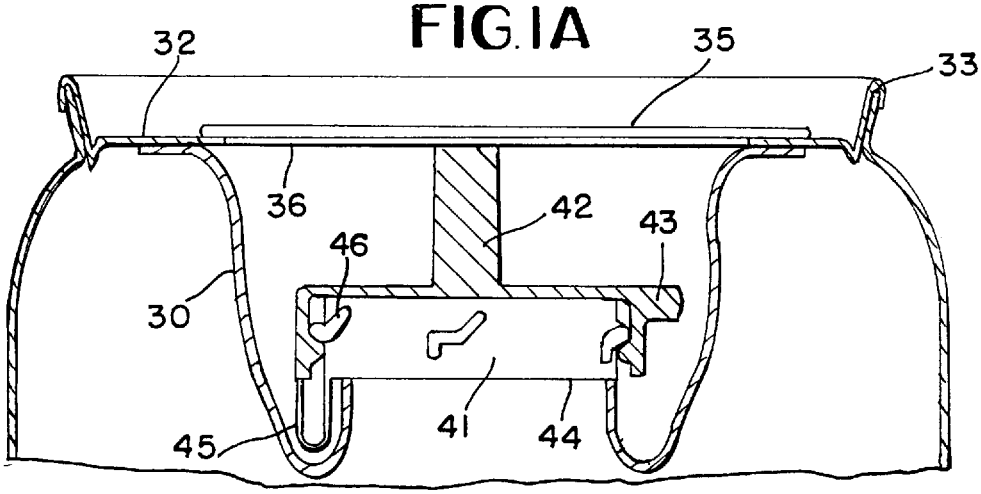
FIGS. 2A to 2D show a further embodiment, which is a variation of that shown by FIGS. 1A to 1C and includes a closure which can be twisted-off and flicked-open by single action using one hand.
Figure 2C:
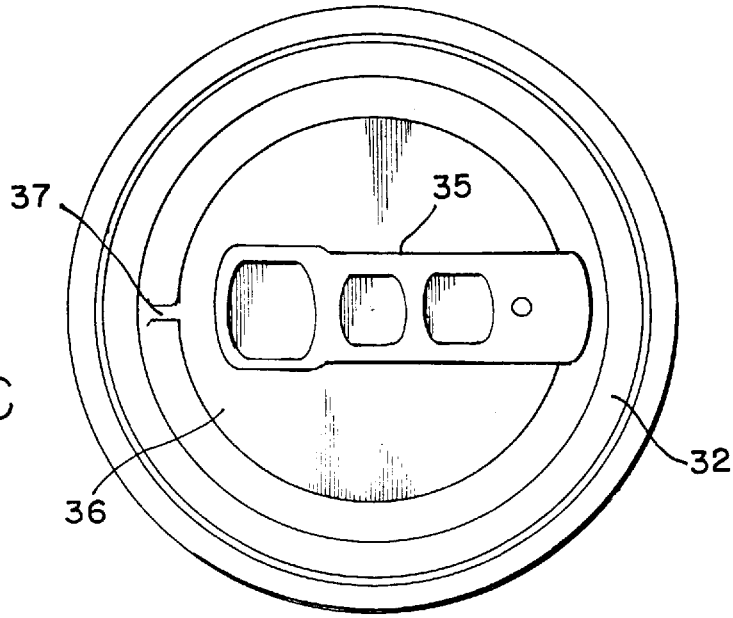
Figure 2B:
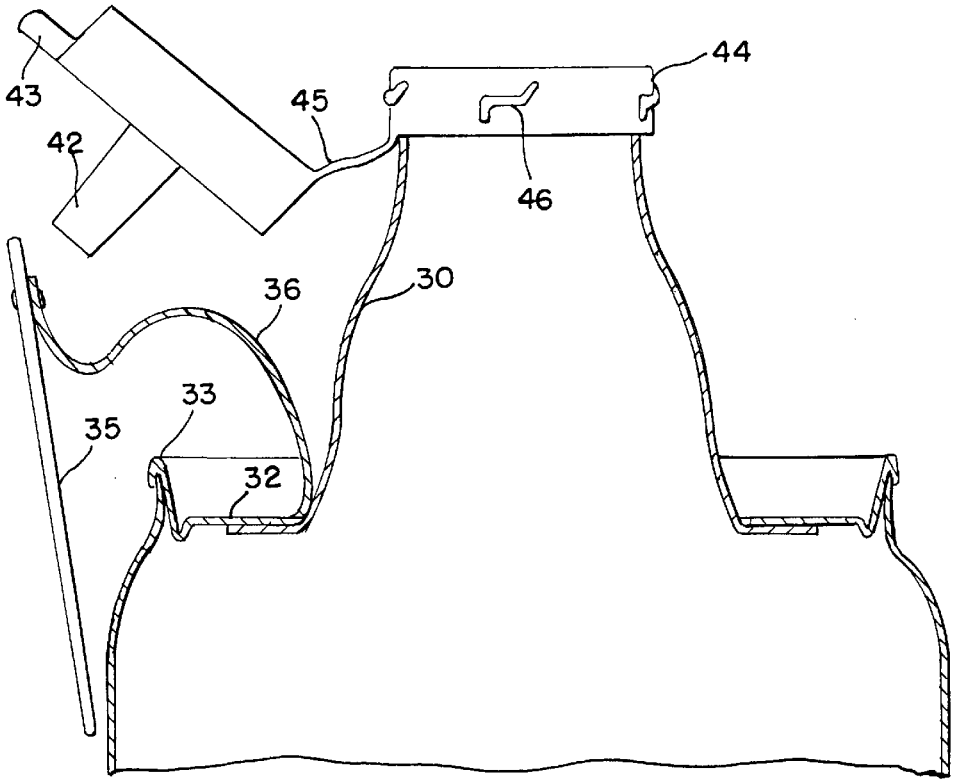
Figure 2D:
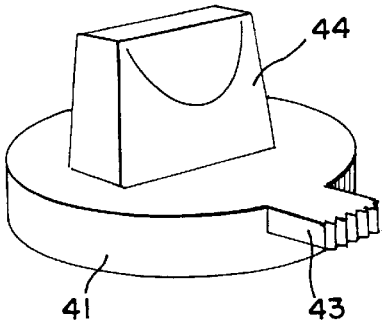

FIGS. 1A to 1C show a folding spout 30 with a screw-closure 31 which is fixed to the underside of a metal can-end 32. In FIG. 1A (a sectional view of the top section on the can 5 before opening) the can-end 32 is rolled into the flange 33 of can 5 in the conventional manner. In FIG. 1B, (a sectional view of the top of the can) 5 after opening) the spout 30 is raised to the position shown by the beverage pressure in the can 5 when the can-end 32 is opened. The screw-closure 31 has ring-tabs 34 which can be folded up and used to pull-out the spout 30 manually in the case of still beverages. FIG. 1C, shows the top of the closed can 5. The can-end 32 has an opening-tab 35, a scored opening section 36, which has a stay-on-bridge 37. When the opening-tab 35 is raised, the opening section 36 can be pulled back fully as demonstrated in FIG. 1B.

FIGS. 2A to 2D show a variation of the embodiment represented by FIG. 1 where a twist-on-flick-open convenience closure 41 is used in place of the screw-closure 31 in FIG. 1, all other features being identical to those already described by FIG. 1. The convenience-closure 41 has a flick-open-lever 42, a twist-open-lever 43, and a collar 44, which is non-removably fixed to the spout 30. A strap 45 attaches the convenience-closure 41 to the non-removable collar 44 on the spout 41. The convenience-closure 41 has molded-in projections 46, which enable the convenience-closure 41 to be twisted-on/twisted-off for opening/closing. The user opens the can-end 32 in the manner already described in FIGS. 1 and the spout 30 is raised by the beverage pressure in the can 5 to the position shown by FIG.

2. The user can then operate twist-open-lever 43 to release the convenience-closure 41, and can then flick it back using flick-open-lever 43. User can also replace convenience-closure 41 by twisting it back on to reseal.

Figure 3:
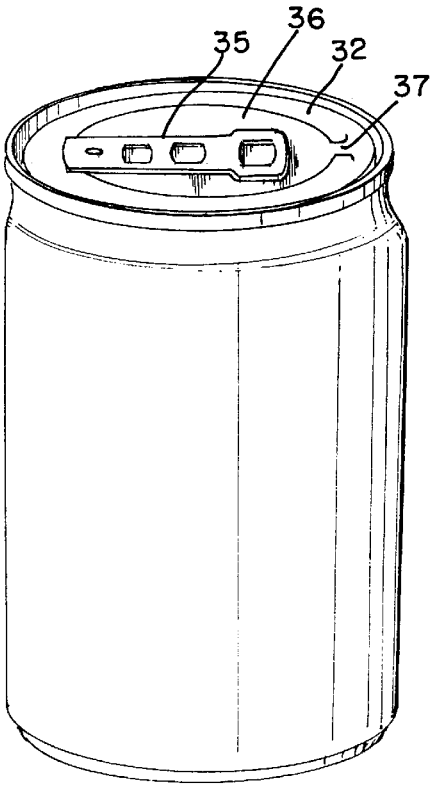
FIG. 3 shows the appearance of the closed can in the case of the embodiments described by FIGS. 1A to 1C and 2A to 2D.

FIG. 3 shows the appearance of a closed can 5 in the case of both embodiments represented by FIGS. 1 and 2.

Figure 4A:
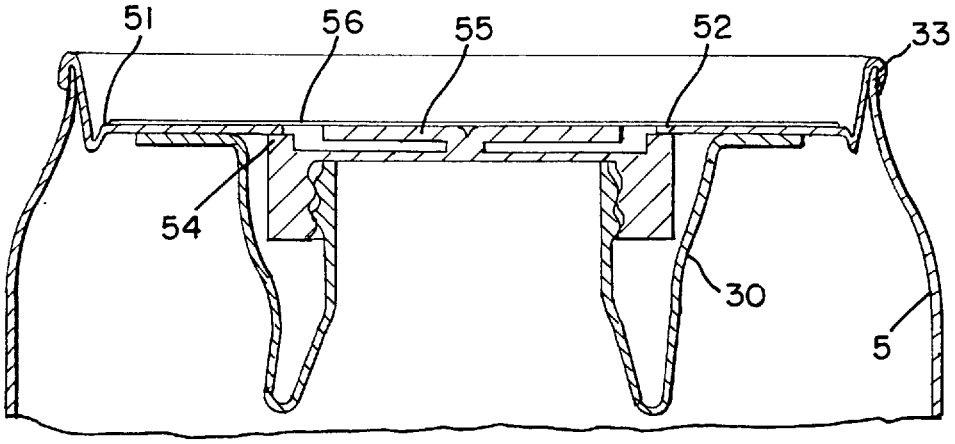
FIGS. 4A to 4D show a still further embodiment, where the metal can-lid has a permanent aperture with serrated edges, and the folded spout has a screw-closure which also has serrated edges, so that these interfere and lock behind the serrated edges of the metal can lid.
Figure 4B:
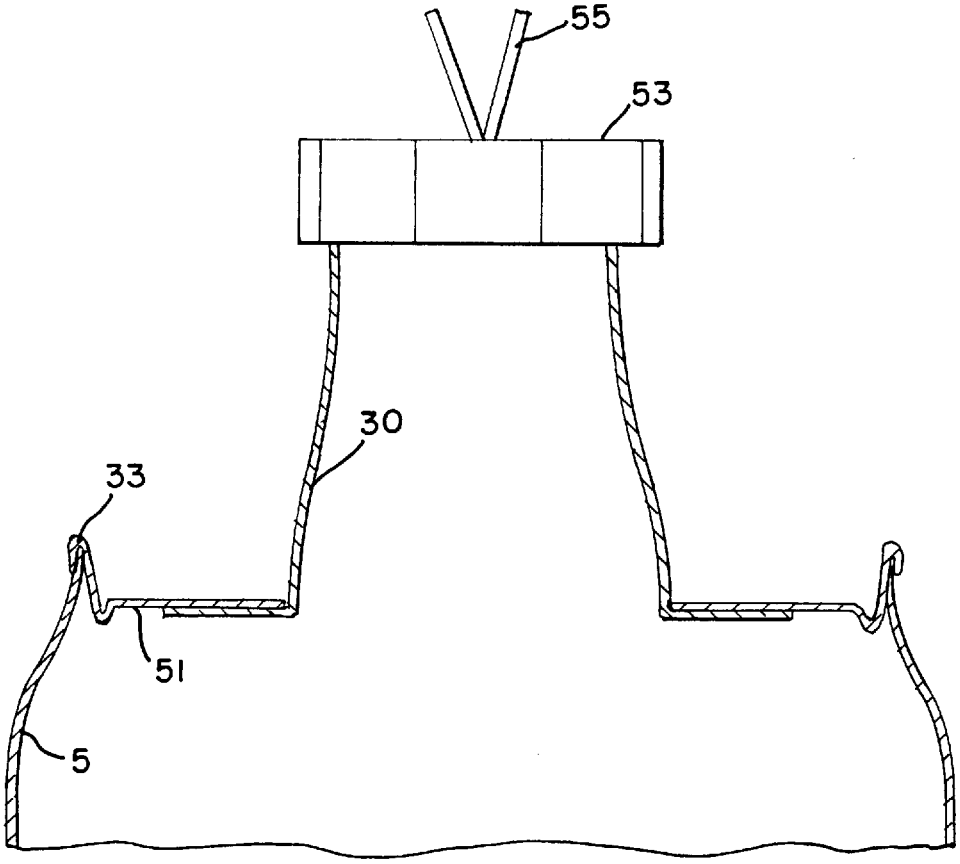
Figure 4C:
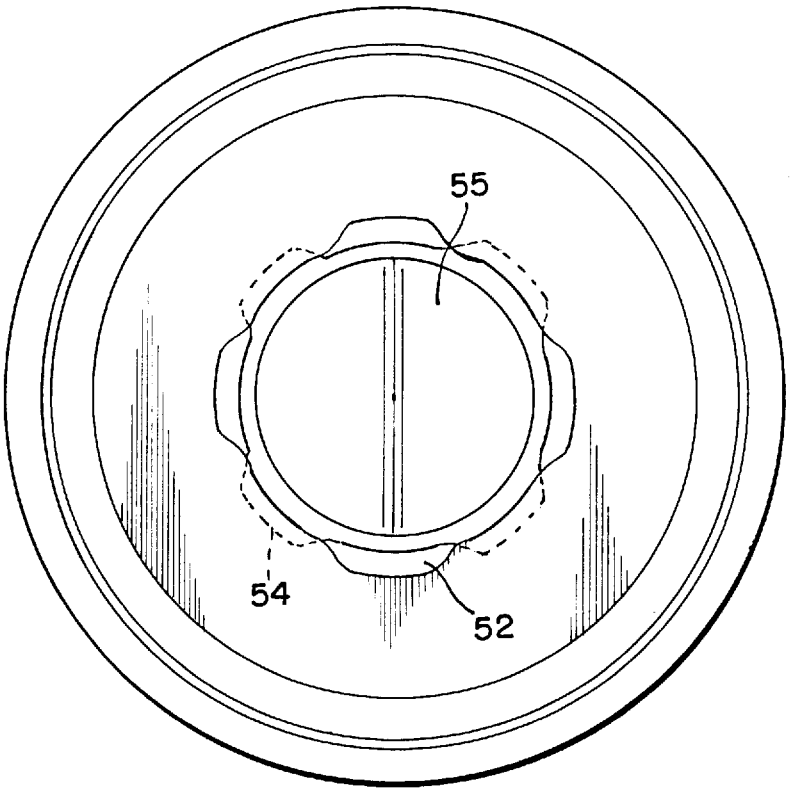
Figure 4D:
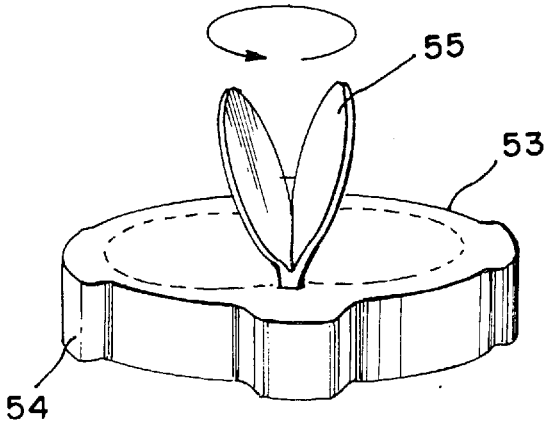

FIGS. 4A to 4D show a further variation using the folding spout 30. In FIG. 4A, a special can-end 51 is conventionally attached to the flange of can 5 by seam 33. The special can-end 51 has an aperture in the middle with serrated-edge 52 (see also FIG. 4C). The special screw-closure 53 locks under the serrated-edge 52 by means of protrusions 54. The special screw-closure 53 has lift-up panels 55, which are hinged so that they can be pulled-up. The user pulls up the lift-up panels 55, twists the special screw-closure 53 so that the protrusions 54 no longer lock under the serrated-edge 52 enabling the spout 30 to be free to rise under beverage pressure. Alternatively, for still beverages, the user can pull-up the spout 30 using the lift-up panels 55. FIG. 4B shows the spout 30 extended, FIG. 4C shows a top view of the special can-end 51 and the special screw-closure 53 in the position where it is locked under the serrated-edge 52. FIG. 4D shows the special screw-closure 53. Pilfer-evidence can be either by label 56 over the aperture of the special screw-closure 53, or by coloring the protrusions 54 of special screw-closure 53 so that the color is removed visibly when the special screw-closure is first rotated.

In the case of the spout 30 versions demonstrated by FIGS. 1, 2 and 4, promotional compartments and/or peel-off labels/liners can be mounted on the underside of the closures associated with these versions.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A can end assembly comprising:

a can body having an open end and a closed end;

a can-lid secured to the can body over the open end, said can-lid having a central severable portion and a peripheral portion secured to the can body;

a foldable spout secured to the underside of the peripheral portion of the can lid, and movable between a first position recessed within said can body and a second position extending from said can body solely in response to release of pressure in the can when the central severable portion is severed from the can-lid;

a pull-tab connected to the central portion of the can-lid; and a removable cap provided on the spout, the cap being removable from and resealable on the spout.

2. The assembly of claim 1 further including a ring-pull on said spout grippable by an operator's fingers after the central portion of the can-lid is removed.

3. The assembly of claim 1 wherein said cap includes twist-on/twist-off locking means associated with cooperating elements on said spout.

4. The assembly of claim 3 further including a tether strap connecting said cap to said spout.

5. The assembly of claim 3 wherein said cap has a first lever extend from a sidewall thereof for rotating the cap about a central axis and a second lever extending from a top wall thereof for rocking the cap off of said spout.

6. The assembly of claim 1 wherein the peripheral portion of the can-lid and the central portion have complementary serrated edges defining interlocking teeth so that in a closed position teeth from the central portion are locked under the teeth of the peripheral portion, but when rotated the teeth of the central portion are released by the teeth of the peripheral portion.

7. The assembly of claim 6 further including at least one tab extending from the central portion of the can lid.

8. The assembly of claim 1 wherein the cap is detachably mounted to an exterior of the spout, the cap being on the spout during movement of the spout from the first position to the second position.

9. The assembly of claim 1 wherein the foldable spout has walls without accordion folds in both the first and second positions.

10. The assembly of claim 9, wherein the foldable spout has a cone shape and wherein the spout extends from adjacent the removable cap to the underside of the peripheral portion of the can lid.

11. The assembly of claim 1, wherein the spout has a cone shape and wherein the spout extends from adjacent the removable cap to the underside of the peripheral portion of the can lid.

12. The assembly of claim 1, wherein the removable cap is located along a central longitudinal axis of the can body when the removable cap is on the spout.

13. A method for providing a drinking spout in a can end, the method comprising the steps of:

providing a can-lid secured to a can body over an open end of the can body;

providing a foldable spout secured to an underside of a peripheral portion of the can lid;

severing a portion of the can-lid;

moving the spout from a first position recessed within said can body to a second position extending from said can body solely in response to release of pressure in the can after the step of severing; and providing a cap on the spout which is detachable from and reinsertable on the spout.

14. The method of claim 13, wherein the foldable spout has walls without accordion folds in both the first and second positions and wherein the method further comprising the steps of:

detaching the cap from the spout after the spout is moved to the second position; and replacing the cap on the spout after the step of detaching to thereby close the can body.

15. The method of claim 13, further comprising the steps of providing the foldable spout with walls without accordion folds in both the first and second positions, the walls of the spout extend from the underside of the peripheral portion of the can lid to an opening in the spout, the opening being for discharge of contents from the can body.

* * * * *